US005568233A

United States Patent [19]

Komada

[11] Patent Number: 5,568,233

[45] Date of Patent: Oct. 22, 1996

[54] APPARATUS FOR DETECTING THE AMOUNT OF REMAINING DEVELOPER

[75] Inventor: Yasuo Komada, Tokyo, Japan

[73] Assignee: Canon Kabushiki Kaisha, Tokyo, Japan

[21] Appl. No.: 377,790

[22] Filed: Jan. 24, 1995

[30] Foreign Application Priority Data

Jan. 28, 1994 [JP] Japan ..... 6-008171

[51] Int. Cl.[6] ..... G03G 21/00

[52] U.S. Cl. ..... 355/246; 355/204; 355/208

[58] Field of Search ..... 355/203, 204, 355/208, 245, 246

[56] References Cited

U.S. PATENT DOCUMENTS 5,216,469 6/1993 Yamada ..... 355/246

5,218,409 6/1993 Tanaka et al. ..... 355/246

5,317,369 5/1994 Nakanishi ..... 355/208

5,387,965 2/1995 Hasegawa et al. ..... 355/246

*Primary Examiner*—Sandra L. Brase

*Attorney, Agent, or Firm*—Fitzpatrick, Cella, Harper & Scinto

[57] ABSTRACT

A developer remain amount detecting apparatus includes a detector for detecting a remain amount of a developer within a developer container, a first memory in which a reference value for a comparison with a detection signal from the detector is prememorized, a second memory for memorizing the reference value read from said first memory, input unit for inputting a value for modifying the reference value memorized in the second memory unit, modifying unit for modifying the reference value memorized in the second memory unit based on the value input by the input unit, and judgement unit for judging whether the developer is present by comparing the reference value memorized in the second memory with the detection signal from the detector.

6 Claims, 5 Drawing Sheets

APPARATUS FOR DETECTING THE AMOUNT OF REMAINING DEVELOPER

BACKGROUND OF THE INVENTION

1. Field of the Invention

The present invention relates to an apparatus for detecting the amount of remaining developer, e.g., for use in an image forming apparatus relying on the electrophotographic method.

2. Related Background Art

In recent years, there have appeared image forming apparatuses relying on the electrophotographic method such as a copying machine, an electrostatic printer, and a facsimile apparatus, wherein a developer container, a photosensitive drum, a primary charger, a developing unit, and a cleaner are integrated as a process cartridge which can be detachably mounted on the image forming apparatus. The maintenance operation is facilitated by replacement of the entire process cartridge.

There are possibly several replacement factors of this process cartridge, but one of such factors involves the case where the developer within the developer container has been used up.

The developer container is prefilled with the developer in an amount determined by the amount of developer used per revolution on the photosensitive drum and the number of revolutions of the photosensitive drum over its life, whereby the developer remaining will decrease when the image forming apparatus is used.

Hence, developer presence/absence detecting means is typically provided in the main body of the image forming apparatus to detect whether or not developer is present, thereby determining the replacement timing of the process cartridge.

An example of such detecting means is illustrated in FIG. 4, wherein a process cartridge 28 is detachably disposed in the apparatus main body, and wherein a photosensitive drum 21 and a developing unit 23 are accommodated integrally inside the process cartridge 28. The developing unit 23 is comprised of a developing portion 23*a* for delivering the developer T toward the photosensitive drum 21 and a developer storing portion 23*d* for storing the developer T within a hopper to supply the developer T into the developing portion 23*b* with the agitation of an agitator 23*c*. An optical path 50 made of a transparent material extends vertically through the process cartridge 28 comprising the developer storing portion 23*d*, and detecting means 52 including an attached light emitting portion 52*a* and a light receiving portion 52*b* across the process cartridge is placed in the apparatus main body facing the optical path 50 to detect the developer T.

As the developer T within the developer storing portion decreases, light emitted from the light emitting portion 52*a* of the developer detecting means 52 will more likely reach the light receiving portion 52*b*. When the light receiving level exceeds a predetermined level, the depletion of developer is detected.

This light emitting portion 52*a* uses an LED and the light receiving portion 52*b* uses a phototransistor or a photodiode.

There is known one method of processing the output signal from the light receiving portion 52*b* to detect the depletion of developer, which method employs a microprocessor unit (MPU) of one chip containing a ROM and RAM.

The MPU is a processor which performs digital control and operation control using a group of instructions stored in a read-only-memory (ROM), including the transaction with a read-write-memory (RAM).

In the case where the light receiving portion 52*b* uses a photodiode, upon the light emitted from the light emitting portion 52*a* reaching the light receiving portion 52*b*, a light receiving current will flow through the photodiode. This light receiving current is converted into a voltage by a current-to-voltage converter, and the voltage is passed into an AD converter for digitization. This digitized light receiving level information is input into the MPU and compared with time or voltage information to determine the presence or absence of developer T (i.e., the state in which the developer remains in an amount sufficient to record on tens of sheets of transfer medium P) which is contained in the group of instructions stored in the ROM, to detect the replacement timing of the process cartridge 28.

A one-chip microcomputer is constructed by enclosing at least a RAM, a ROM having the operation programs stored therein, and a central processing unit (CPU) into one package.

Accordingly, the developer detecting means as above described has the disadvantage that when the information for determining the presence of developer is stored within the ROM of the one-chip microcomputer, the one-chip microcomputer must be reconfigured by rewriting the information within the ROM if there is a need for changing that information, thereby resulting in more cost and time.

On the other hand, if the presence or absence of the developer is determined based on the current flowing through the photodiode on the light receiving side, it is requisite that the remaining amount of developer may correspond to the photoelectric current flowing through the photodiode on the light receiving side in order to enhance the detection accuracy.

That is, it is necessary that a state of constant transmittance may correspond to the photoelectric current passing therethrough.

Herein, it is noted that the amount of luminescence produced when passing current through the light emitting element differs considerably between individual light emitting elements. Also, the conversion efficiency in converting the light received by the light receiving element into photoelectric current varies between individual light receiving elements.

In order to correspond the remaining amount of developer to the photoelectric current, it is necessary to adjust the amount of luminescence or the degree of amplification of the amount of light received.

SUMMARY OF THE INVENTION

An object of the present invention is to provide an apparatus for detecting the amount of remaining developer in which the above-mentioned disadvantage is eliminated.

It is another object of the invention to provide an apparatus for detecting the of remaining developer which can change the developer presence/absence information with a one-chip microcomputer comprising a ROM which stores the operation program of control means for detecting whether or not the developer is present, by providing externally the information or setting for determining whether or not developer is present to the one-chip microcomputer when replacement is not easy due to problems regarding the packaging location.

It is a further object of the invention to provide an apparatus for detecting the amount of remaining developer and a light amount regulating device which allow the apparatus itself to make the adjustment without having to connect any measuring device.

It is another object of the invention to provide an apparatus for detecting the amount of remaining developer which can enhance the accuracy of detecting the amount of developer remaining with a simple operation.

It is another object of the invention to provide an apparatus for detecting the amount of remaining developer which can facilitate changing the reference for determination in detecting the developer remaining or adjusting the output of the light emitting element for detecting the developer remaining.

Other objects of the present invention will be more apparent from the following description with reference to the accompanying drawings and claims.

DETAILED DESCRIPTION OF PREFERRED EMBODIMENTS

Figure 1A:
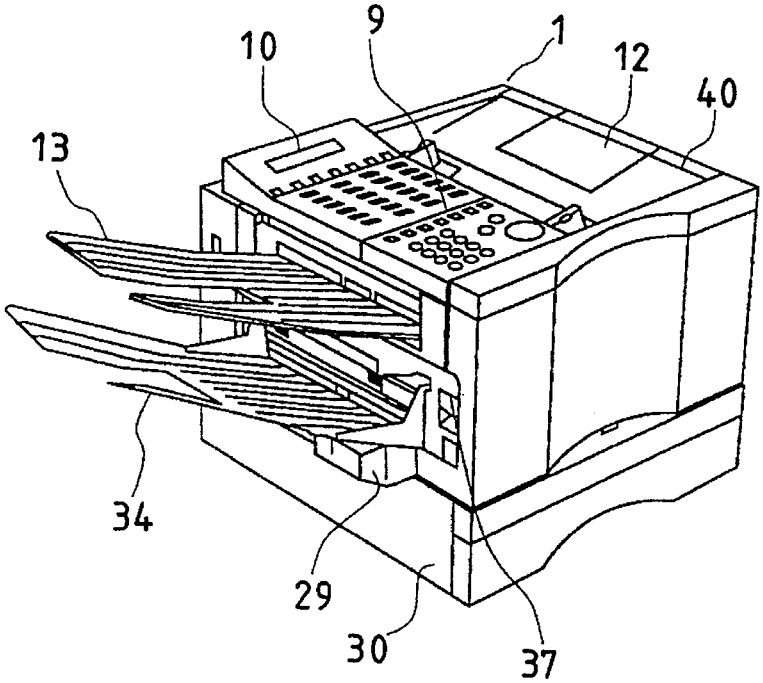
FIGS. 1A and 1B are external appearance views of a facsimile apparatus.
Figure 1B:
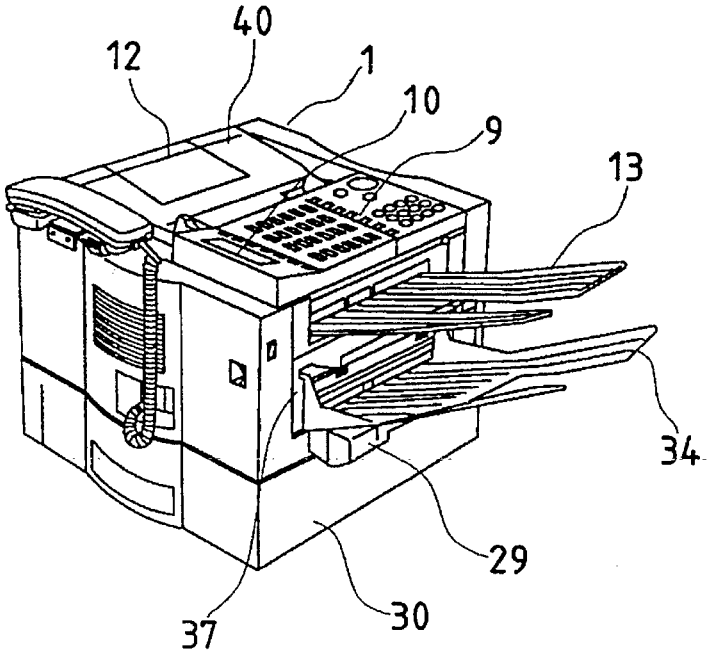
Figure 2:
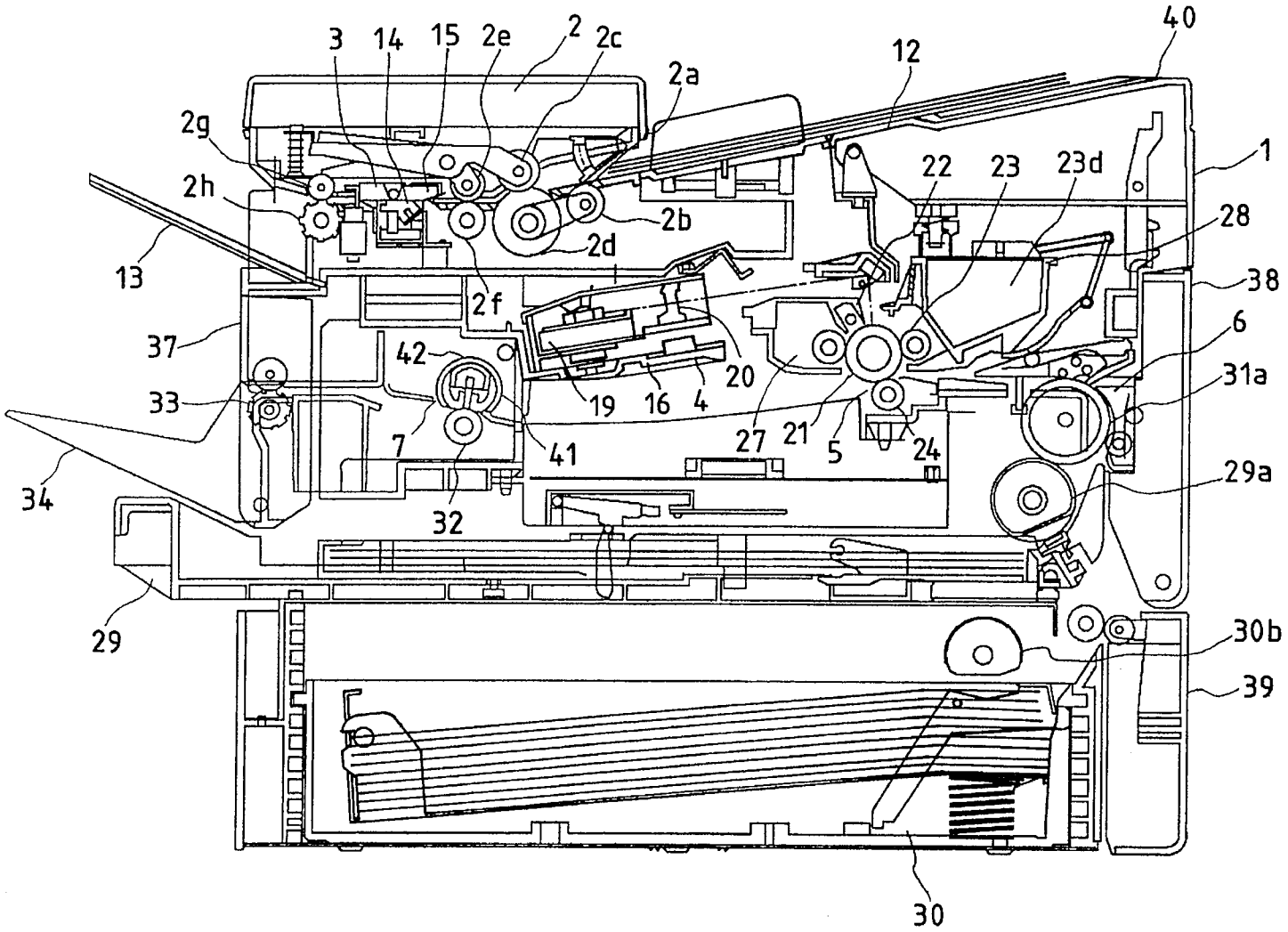
FIG. 2 is a cross-sectional view of the essence of the facsimile apparatus.

A first embodiment of the present invention will be detailed with reference to FIGS. 1A to 3.

First, the construction of a facsimile apparatus according to the present invention will be presented.

The main body of the facsimile apparatus 1, includes an original conveying unit 2, a reading unit 3, an optics unit 4, an image forming unit 5, a transfer medium conveying unit 6, an image fixing unit 7, a communication unit 8, an operation unit 9, a display unit 10 and a control unit 11.

The original conveying unit 2 picks up one original S from a plurality of originals laid on an original tray 12 with the aid of a preliminary conveying roller 2*b* contacted by a preliminary conveying presser piece 2*a* and a separation roller 2*d* contacted by a separation presser piece 2*c*, whereby original S is conveyed into the reading unit 3 by a paper supply roller 2*f* contacted by a paper supply roll 2*e*. After image information of the original S is read in the reading unit 3, the original S is discharged into an original discharge tray 13 by a paper discharging roll 2*g* and a paper discharging roller 2*h*.

The reading unit 3 is constituted of an image sensor 14 composed of a CCD and an original presser plate 15. A light source composed of an LED array direct light to the image plane of the original S, the reflecting light being imaged via a short focus lens array onto the image sensor 14 to read the image information. The image information read by the image sensor 14 is passed to the control unit 11 to undergo processings including shading correction and A/D conversion. Thereafter, the image information is sent to the optics unit 4 or communication unit 8 for image communication or recording with the apparatus.

In the optics unit 4, a laser diode 17 of a laser scanner 16 is caused to emit light in accordance with an image signal sent from the control unit 11 to generate a modulated laser beam. The modulated laser beam is transformed into parallel light through a collimator lens 18, and then entered into a polygon mirror 19 which is rotated at a constant speed. The laser beam reflected from the polygon mirror 19 is focused on a photosensitive drum 21 by an imaging lens 20 disposed in front of the polygon mirror 19. If the polygon mirror 19 is rotated at a constant speed, the laser beam scans across the photosensitive drum 21 at a constant rate. If the photosensitive drum 21 is rotated at a constant speed and the laser beam scans across the photosensitive drum 21 at a constant rate, an electrostatic latent image is formed on the photosensitive drum 21.

In the image forming unit 5, there are disposed around the photosensitive drum 21, composed of an electrically conductive drum and a photoconductive layer, a primary charger 22, a developing unit 23, a transfer charger 24, a cleaning unit 25 of the blade type, and a static discharger 26. Herein, the photosensitive drum 21, the primary charger 22, the developing unit 23, the cleaning unit 25, and the static discharger 26, with a developer withdrawal vessel 27, are integrally accommodated an a process cartridge 28. This process cartridge can be mounted detachably on a mounting member of the apparatus main body. Also, the photosensitive drum 21, the primary charger 22, the developing sleeve 23*a* within the developing unit 23, and the transfer charger 24 are driven by a motor M2. The photosensitive drum 21 being driven is passed by the primary charger 22 to be negatively charged on its surface evenly, and then exposed to a laser beam from the laser diode 17. By illumination of this laser beam, negative electric charges present in the light part (as illuminated by the beam) on the photosensitive drum are neutralized, so that an electrostatic latent image is formed thereon. And if the electrostatic latent image comes close to the developer T in the developing unit 23, the developer T negatively charged will jump to the surface of the photosensitive drum 21 due to a potential difference between the latent image and the developing unit 23 to visualize the image. A toner image on the photosensitive drum is transferred onto the transfer medium P if the photosensitive drum is positively charged by the transfer charger 24.

The surface of the photosensitive drum 21 which after transfer has any residual toner removed by the cleaning unit 25, and the drum potential is made uniform by the primary charges 22 to prepare for the next formation of an electrostatic latent image. The residual toner removed from the drum surface is withdrawn into the developer withdrawal vessel 28.

In the transfer conveying unit 6, a first cassette 29 and a second cassette 30 are mounted in the main body of the apparatus such that they can be drawn therefrom. The transfer medium P set on the first cassette 29 or the second cassette 30 can be selectively delivered. First, when the transfer medium P set on the first cassette 29 is conveyed, the driving of the motor M2 is transmitted to the semicircular paper supply roller 29*a* by the driving of a paper supply solenoid SL1 to separate one transfer medium P owing to the rotation of the paper supply roller 29*a*. The transfer medium P separated is conveyed by the conveying roller 31*a*. In doing so, if the leading edge position of the transfer medium P being fed is detected at the conveying timing when the leading edge of toner image formed on the photosensitive drum 21 and the leading edge of the transfer medium P coincide, the transfer medium P is conveyed between the photosensitive drum 21 and the transfer charger 24 by the conveying roller 31*a*. Then, when the transfer medium P set on the second cassette 30 is conveyed, the driving of the motor M2 is transmitted to the semicircular paper supply roller 30*a* by the driving of a paper supply solenoid SL2 to separate one transfer medium P owing to the rotation of the paper supply roller 30*a*, so that the transfer medium P is conveyed to the conveying roller 31*a* by a cassette conveying roller 30*b*. Thereafter, the transfer medium P separated is conveyed by the conveying roller 31*a*, wherein if the leading edge position of the transfer medium P being fed is detected by a register sensor 31*b*, at the conveying timing when the leading edge of toner image formed on the photosensitive drum 21 and the leading edge of the transfer medium P coincide, the transfer medium P is conveyed between the photosensitive drum 21 and the transfer charger 24 by the conveying roller 31*a*.

In the image forming unit 5, the transfer medium P onto which the image has been transferred is further conveyed by a fixing roller 32 and a paper discharging roller 33 which are driven by the motor M2, and discharged onto the transfer medium discharge tray 34. Note that the paper supply unit and the paper discharging unit have a paper supply sensor 35 and a paper discharge sensor 36, respectively, to detect the arrival or passage of the transfer medium P. If the transfer medium does not arrive at or pass by each sensor unit within a predetermined time, the occurrence of a conveyance failure of the transfer medium P is determined, and an error message is displayed. Also, the main body 1 of the apparatus has a first lid 37, a second lid 38, a third lid 39 and an upper cover 40 attached thereto such that they are openable or closable. The first lid 37 is used to remove a transfer medium jammed in the paper discharging unit, the second lid 38 and the third lid 39 are used to remove a transfer medium jammed in the paper supply unit, and the upper cover 40 is used to remove a transfer medium jammed in the process cartridge 28 and to mount or demount the process cartridge 28.

The image fixing unit 7 is comprised of a heater 41, a fixing film 42, the fixing roller 32, and the paper discharging roller 33. The surface temperature of the heater 41 is sensed by the variation in resistance value of a thermistor set on the heater 41, and controlled to be constant. The fixing film 42 is warmed by the heat of the heater. In the image forming unit 5, the transfer medium P onto which the toner image has been transferred is subjected to pressure and heat by means of the fixing film 42 and the fixing roller to fix the toner image. A transfer medium having a toner image fixed thereon is discharged onto the recording sheet discharge tray 34.

The communication unit 8 connects the apparatus 1 itself to the communication line or to talking equipment such as a telephone, thereby effecting the modulation or demodulation of image communication data, the detection of a predetermined signal, or the switching of the connection to a signal channel.

The operation unit 9 is comprised of a plurality of key input switches or a circuit for detecting the key input, thereby effecting the operation instruction of the apparatus of the input of a variety of kinds of information.

The display unit 10 displays the state of the apparatus, the telephone number of the calling party, the clock information and the operation procedure.

A control unit controls various types of means in the apparatus as described above.

Figure 3:
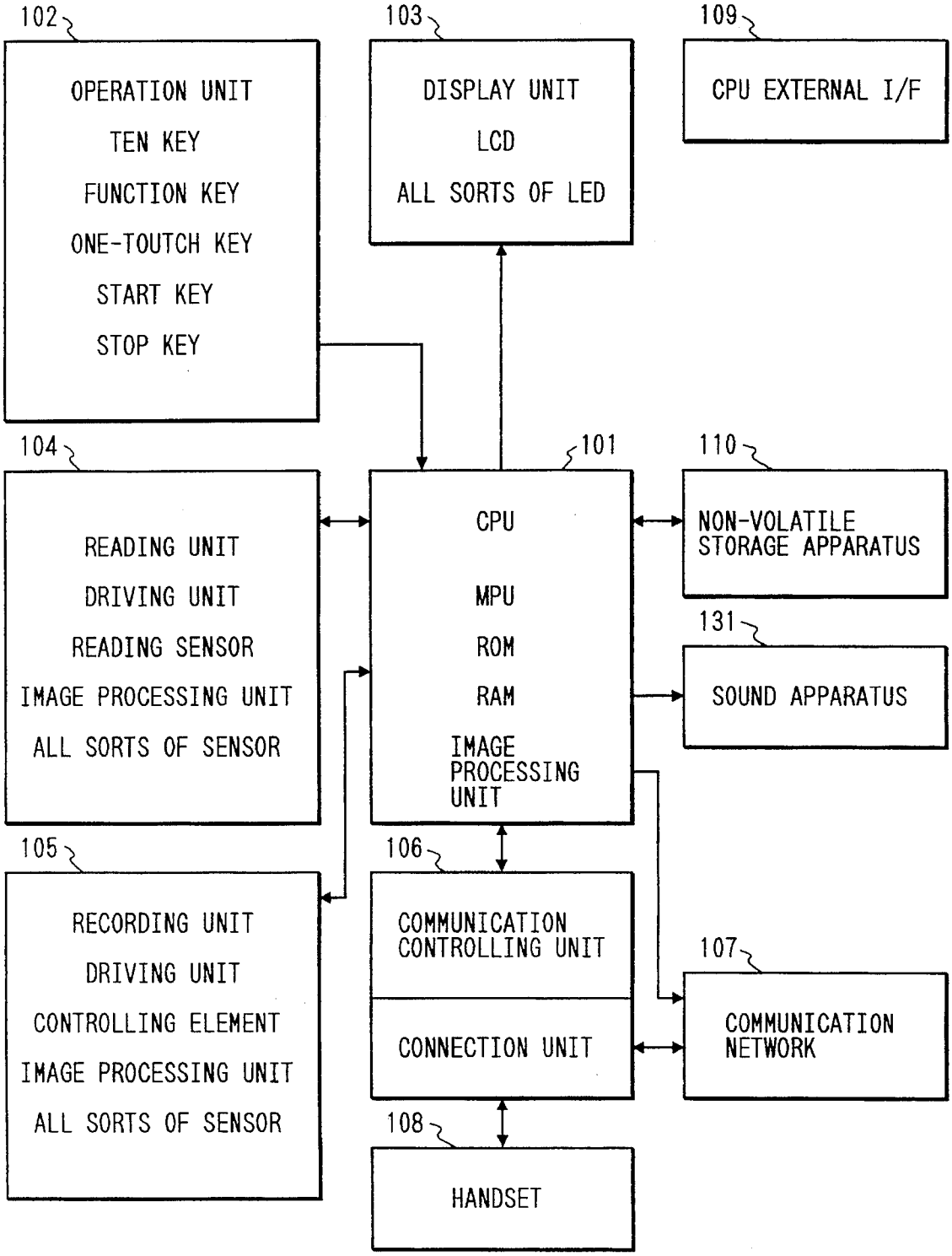
FIG. 3 is a block diagram showing the configuration of the facsimile apparatus.

FIG. 3 is a block diagram of a control system 100 of the facsimile apparatus. In the figure, 101 is a CPU for controlling the entire facsimile apparatus, comprising an MPU 111, a ROM 112 in which a group of instructions describing the operation of the MPU 111 are stored, a RAM 113 usable as a work area for various kinds of data processing or temporary storage of image information, and an image processor 114 for making possible variable magnification of an image or resolution conversion. Also, the CPU 101 is provided with a calendar and a clock function, and the RAM 113 is backed up with a battery to hold data in the event of power outage.

The control system of the facsimile apparatus is configured to connect the CPU 101 and the elements 102 to 110 as presented below through an interface.

The operation unit 102 is comprised of a variety of types of key switches including a ten key 115, a function key 116, a one-touch key 117, a start key 118, and a stop key 119.

The display unit 103 is comprised of a display 120 composed of an LCD for displaying a variety of messages, and various types of displays 121 composed of LEDs for displaying the transmission mode and so on.

The reading unit 104 is comprised of a driving unit 122 such as a reading motor, a reading sensor 123 for reading the image, an image processor unit 124 for making the shading or binarization of the read image, and a variety of sorts of sensors 125 for sensing the original.

The recording unit 105 is comprised of a driving unit 126 such as a recording motor, a control element 127 for controlling the laser scanner or electrophotographic process, an image processing unit 128 for smoothing the image being recorded, and a variety of sorts of sensors 129 for detecting the presence of the recording sheet.

The communication control unit 106 effects the calling or called operation, or the encoding of image data, and comprises a connection unit 130 composed of a DSU and an NCU, to which a communication network 107 and a handset 108 are connected.

A CPU external interface 109 is an interface for making transmission or reception of data directly from the CPU 101, allowing the connection to a computer placed outside of the apparatus through, for example, an RS232C interface, an SCSI interface, on a LAN, so that the apparatus is usable as a scanner, a printer or communication means for the external computer. An HDD 110 is used to save image information as a large capacity nonvolatile storage device.

A control element 44 controls recording by inputting or outputting the signals to or from the optics unit 4, the image forming unit 5, the transfer medium conveying unit 6 and the image fixing unit 7, while interfacing with a microprocessor unit (MPU) 45 for controlling the entire facsimile apparatus.

The control element 44 comprises a ROM describing a variety of instructions for controlling the recording, reading means for reading the instruction from the ROM, processing means for processing the read instruction, a RAM for storing information needed by the processing means, and output means for outputting the signal produced by a processing circuit, thereby effecting the control through the interaction of these means.

Next, developer presence detecting means will be described.

Figure 4:
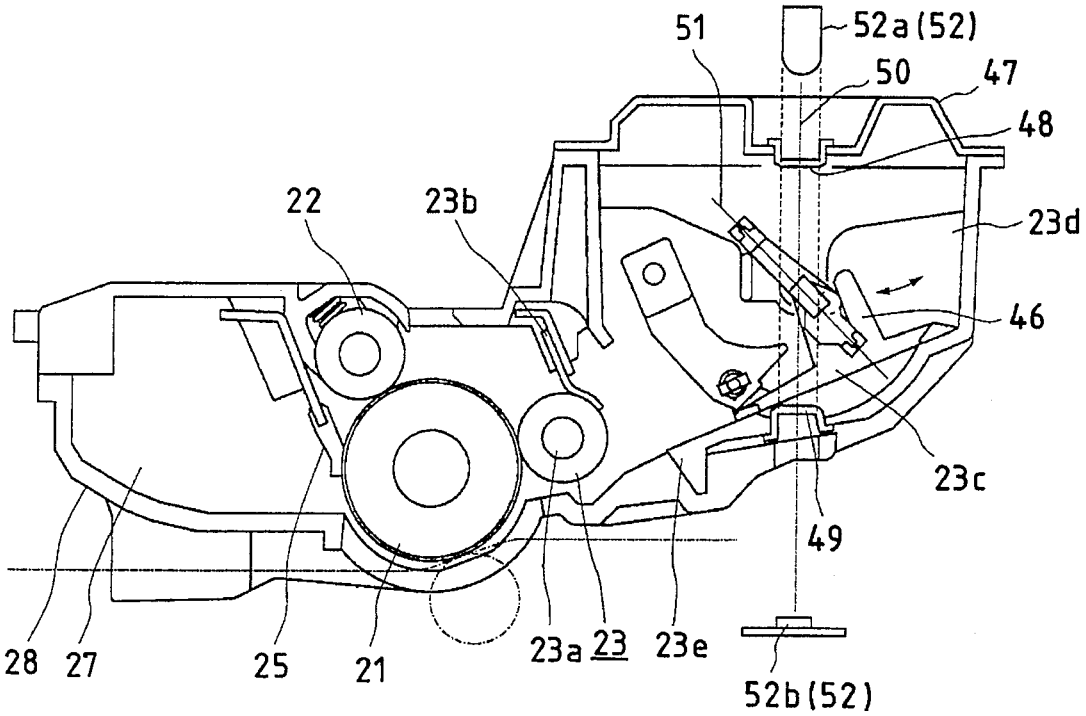
FIG. 4 is a cross-sectional view of a process cartridge.

FIG. 4 shows the state in which the process cartridge 28 is mounted detachably in the mounting member of the apparatus main body 1. This process cartridge 29 is comprised of a photosensitive drum 21, a primary charger 22, a developing unit 23, a cleaning unit 25 of the blade type, a static discharger 26, and a developer withdrawal vessel 27.

The developing unit 23 comprises a developing sleeve 23*a*, a developing portion 23*b*, and a developer storing portion 23*d* from which the developer T stored is supplied to the developing portion 23*b* with the aid of an agitator unit 23*c*. The agitator unit 23*c* has an agitator rod 46, whereby if the agitator rod 46 is reciprocated in the directions of the arrow as shown, the developer T within the developer storing portion 23*d* is delivered to the developing portion 23*b*, and supplied via the developing sleeve 23*a* to the photosensitive drum 21 to perform a developing operation. The developer storing portion 23*d* in the process cartridge 29 is provided with a remaining toner detecting upper window 48 and a remaining toner detecting lower window 49 made of a transparent material in a bottom wall 23*e* and a container lid 47, respectively, with an optical path 50 for transmitting light extending in a straight line vertically through the developer storing portion 23*d*. Also, the remaining toner detecting upper window 48 and the remaining toner detecting lower window 49 of the developer storing portion 23*d* have their inner faces cleaned by a sheet member 51 attached to the agitator rod 46 of the agitator unit 23*c*.

In the developer detecting means 52, a light emitting portion 52*a* is composed of a light emitting diode, and a light receiving portion 52*b* is composed of a photodiode.

Figure 5:
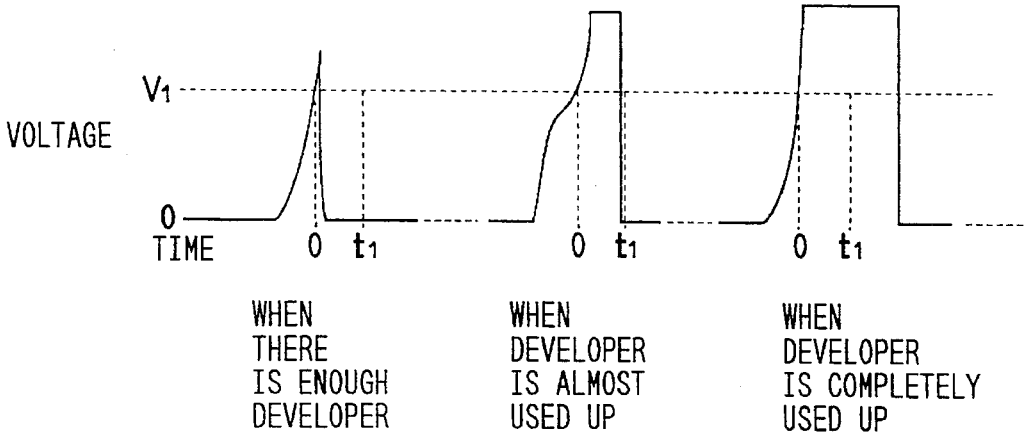
FIG. 5 is a chart showing the state of detection of remaining developer using the present remaining developer detecting means.

Next, a process of detecting whether or not the developer T is present within the developer storing portion 23*d* of the developing unit 23 with developer detecting means 52 will be described. The states detected herein are shown in FIG. 5.

When there is enough developer T within the developer storing portion 23*d*, light from the light emitting portion 52*a* of the developer detecting means 52 is interrupted by the developer, not reaching the light receiving portion 52*b*. Therefore, it is determined that there is enough developer T within the developing unit 23. Next, when the developer T within the developer storing portion 23*d* is almost used up, the agitator rod 46 and the sheet member 51 pass across the remaining toner detecting upper window 48 and the detecting lower window 49, and only at the moment when there is no transfer medium P on the optical path 50 does the light from the light emitting portion 52*a* reach the light receiving portion 52*b*. Thus, a photoelectric current will arise in the light receiving portion 52*b* in accordance with the light illuminating time and the light quantity level.

Next, when the developer T within the developer storing portion 23*d* is completely used up, the light from the light emitting portion 52*a* should arrive at the light receiving portion 52*b*, but may be partly interrupted by the agitator rod 46, the sheet member 51 and the transfer member P.

The above description is commonly applicable to the embodiments, but only the intrinsic portion of the first embodiment will be described below.

Figure 7:
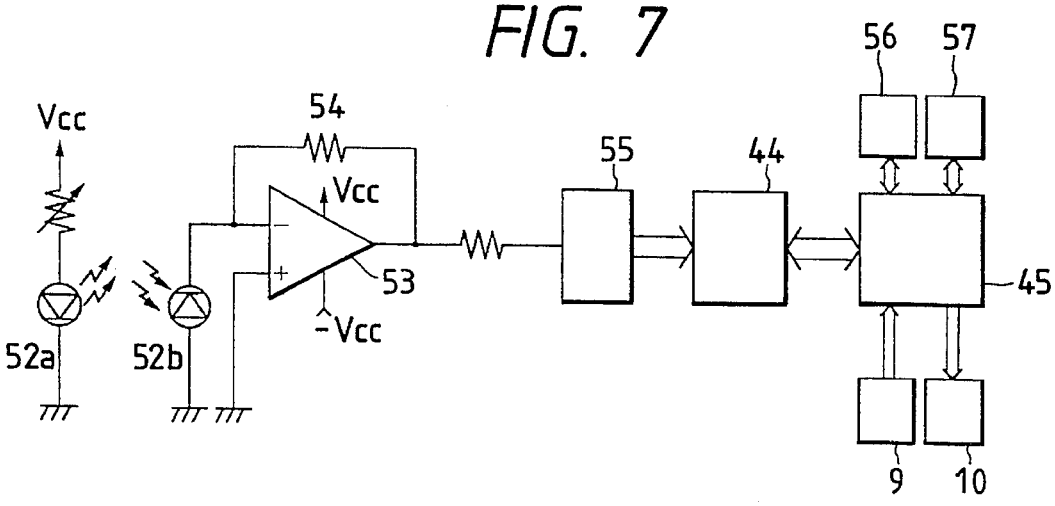
FIG. 7 is a block diagram of the present remaining developer detecting means.

FIG. 7 is a block diagram showing the configuration of developer remaining detecting means. The photodiode of the light receiving portion 52*b* is grounded on the anode side, the cathode side being connected to an inversion input terminal of an operational amplifier 53 used for the current-to-voltage conversion. The photodiode 52*b*, upon receiving the light, converts the light into a linear photoelectric current corresponding to the light intensity. This photoelectric current flows through a resistor 54 connected between the output of the operational amplifier 53 and the inversion input terminal, whereby an analog output voltage proportional to the photoelectric current is obtained in the output of the operational amplifier 53. Further, this analog output voltage is converted into an 8-bit digital value by an analog-to-digital converter (A/D converter) 55, which digital value is input into an input port of the control element 44.

That is, when there is enough developer, the photodiode 52*b* receives less light, so that the control element 44 has a smaller digital value, whereas when there is less developer, the photodiode receives a larger amount of light, so that the control element 44 has a greater digital value.

Figure 6:
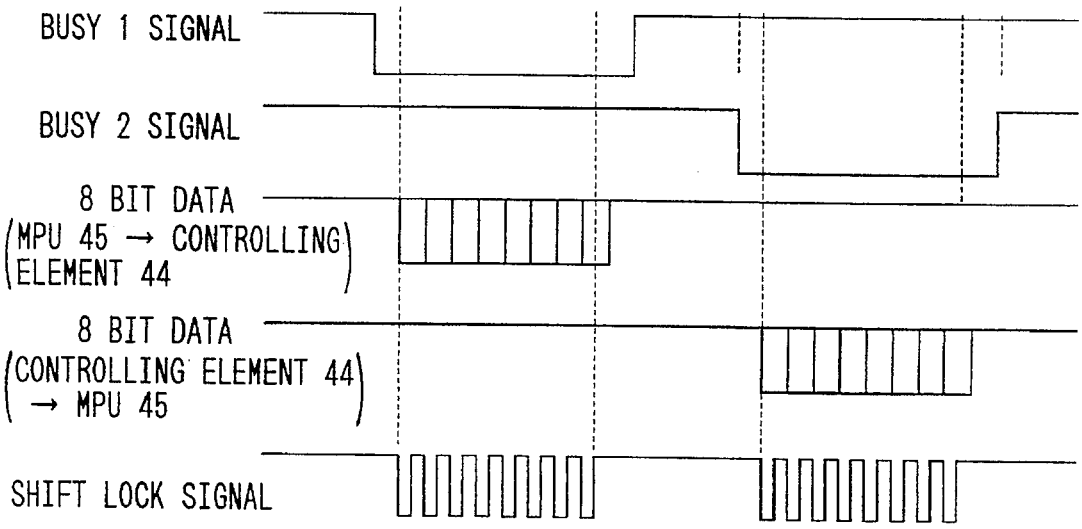
FIG. 6 is a timing chart for the serial transfer of the remaining developer detecting information.

Prior to this, at least when the facsimile apparatus is started, the MPU 45 for controlling the entire facsimile apparatus reads, from the ROM 56, the 8-bit digital values D1 and D2 corresponding to voltage a predetermined level V1 and time t1 to determine the presence of the developer T in the developing unit 23, and transfers these values serially in a unit of 8 bits to the control element 44, synchronously with the clock signal. The ROM 56 stores the digital values D1 and D2 as a table, in addition to a facsimile operation program. The timing chart of the serial transfer is shown in FIG. 6.

The MPU 45 sends a BUSY1 signal to the control element 44 before making the serial transfer. The control element 44 receives the BUSY1 signal through an interrupt port, and immediately receives 8-bit shift data sent from the MPU 45, synchronously with a rising edge of the shift clock signal sent from the MPU 45, storing the data in a serial data register (SDR) within the control element, and further transferring it to the RAM within the control element.

Thereby, the control element 44 receives, from the MPU 45, the 8-bit digital values D1 and D2 as the data corresponding to the predetermined voltage level V1 and time t1 to determine the presence of the developer T within the developing unit 23, and stores it as the developer presence determining information into the RAM.

On the basis of the developer information, the control element 44 activates a count-up timer of t1 seconds, if the digital value input into the input port is greater than or equal to a digital value D1 corresponding to a predetermined voltage value V1. If the digital value is less than D1 before the timer counts t1 seconds, the timer is stopped, indicating that there is enough developer for the recording. If the digital value input is continuously not less than the D1 for t1 seconds or more, the replacement timing of the process cartridge 29 is detected, thereby determining that there is no developer.

Note that since the A/D converter 55 has a resolution of 8 bits, the control element 44 has a discriminating capability of up to 256 sorts of voltage value.

It does not matter that this embodiment may be configured as follows.

While the control element 44 has been described as a one-chip microcomputer containing ROM and RAM, it will be appreciated that the one-chip microcomputer may contain an A/D converter, instead of having the A/D converter 55 separately.

The ROM and RAM of the control element 44 may be connected externally, but not provided as one package.

The serial transfer may take the transmission form of star-stop synchronization, rather than using the line for a hand shaking operation.

A second embodiment of the present invention will be described below.

The basic operation has been already described in the first embodiment, and the second embodiment will be described in connection with only the intrinsic portion thereof.

Either or both of the digital values D1 and D2 are made variable in accordance with the input of a change request instruction from the operation unit 9.

If a change request instruction of voltage value for detecting the presence of remaining developer is entered, the voltage value currently set and a message for prompting the user to input the digital value corresponding to the voltage value after change, appear on the display 10. If a numerical value corresponding to a new voltage value is input from the ten key input of the operation unit 9, the digital value D3 corresponding thereto is input as the 8-bit data into the input port of the MPU 45.

If a change request instruction of the time for detecting the presence of remaining developer is entered, the time currently set and a message for prompting the user to input the digital value corresponding to the time after change, appear on the display 10. If a numerical value corresponding to a new time is input from the ten key input, the digital value D4 corresponding thereto is input as the 8-bit data into the input port of the MPU 45.

If these operations are performed, the digital values D1 and D2 are changed to the values D3 and D4, respectively, which are then held in the RAM 57. The values D3 and D4 stored in the RAM 57 are transferred serially in a unit of 8 bits to the control element 44, synchronously with the clock signal. The timing chart of the serial transfer is shown in FIG. 6.

The MPU 45 sends a BUSY1 signal to the control element 44 before making the serial transfer. The control element 44 receives the BUSY1 signal through an interrupt port, and immediately receives 8-bit shift data sent from the MPU 45, synchronously with a rising edge of the shift clock signal sent from the MPU 45, and stores the data in a serial data register (SDR) within the control elements. MPU 45 further transfers the data to the RAM within the control element 44.

Thereby, the control element 44 receives, from the MPU 45, the 8-bit digital values D3 and D4 as the data corresponding to predetermined voltage level V1 and time t1 to determine the presence of the developer T within the developing unit 23, and stores it as the developer presence determining information into the RAM within the control element 44.

On the basis of the developer information, the control element 44 activates a count-up timer of t2 seconds corresponding to the digital value D4, if the digital value indicating the voltage input into the input port after the photodiode 52*b* receives the light is greater than or equal to digital value D3 corresponding to a predetermined voltage value V2. If the digital value is less than D3 before the timer reaches t2 seconds, the timer is stopped, indicating that there is enough developer for the recording. If the digital value input into the input port is continuously not less than the D3 for t2 seconds or more, the replacement timing of the process cartridge 29 is detected, determining that there is no developer.

Note that since the A/D converter 55 has a resolution of 8 bits, the control element 44 has a discriminating capability of up to 256 sorts of voltage value.

It will be appreciated that the predetermined digital values D1 and D2, together with the operation program of the control element 44, may be stored in the ROM, and the remaining developer detecting information may not be transferred serially between the control element 44 and the MPU 45 unless a change request of the digital values D1 and D2 is issued from the operation unit 9.

It also will be appreciated that the input from the operation unit 9 may be connected directly to the control element 44, without intervention of the MPU 45, whereby the MPU 45 is not involved in changing the remaining developer detecting information at all.

It also will be appreciated that the RAM 57 holding the remaining developer detecting information input from the operation unit 9 may be backed up in memory, whereby the remaining developer detecting information is serially transferred automatically to the control element 44, and is stored in the RAM within the control element 44, every time the facsimile apparatus is started.

A third embodiment of the present invention will be described below.

Since the basic operation has been already described in the first embodiment, only the intrinsic portion of the third embodiment will be described below.

When the presence of remaining developer is determined based on the current flowing through the photodiode on the light receiving side, it is requisite that the remaining amount of developer may correspond to the photoelectric current flowing through the photodiode on the light receiving side in order to enhance the detection accuracy.

That is, it is necessary that the state of constant transmittance may correspond to the photoelectric current passing therethrough.

Herein, it is noted that the amount of luminescence produced in passing current through the light emitting element differs considerably between individual light emitting elements. Also, the conversion efficiency in converting the light received by the light receiving element into photoelectric current varies between individual light receiving elements.

In order to correlate the remaining developer amount to the photoelectric current, it is necessary to adjust the amount of luminescence.

First, the process cartridge 29 is removed from the main body of the facsimile apparatus to produce a state of constant transmittance. Thereby, there is no obstacle between the light emitting portion 52*a* and the light receiving portion 52*b*, in which the transmittance is almost 100%. The digital value D5 for the optimal light receiving current at this time is stored as the data into the ROM within the control element 44.

Now, supposing that the digital value corresponding to the photoelectric current flowing therethrough upon receiving the light is D6, it can be said that the light receiving amount is less than the optimal value if D5 is greater than D6, the light receiving amount is greater than the optimal value if D5 is less than D6, and the light receiving amount is optimal if D5 is equal to D6. By displaying this difference D7 (=D6−D5) on display means, the coordinator can determine the magnitude of light receiving current flowing at present and how much correlation is additionally needed.

The operation for displaying this difference is as follows. The control element 44 transfers serially the digital value D7 in a unit of 8 bits to the MPU 45, synchronously with the clock signal. The timing chart of this serial transfer is shown in FIG. 6.

The control element 44 sends a BUSY2 signal to the MPU 45 before making the serial transfer. The MPU 45 receives the BUSY2 signal through an interrupt port, and immediately receives 8-bit shift data sent from the control element 44, synchronously with a rising edge of the shift clock signal sent from the MPU 45 and stores the data in a serial data register (SDR) within the control element. MPU 45 further transfers these values to the RAM within the control element A.

A command for displaying the digital value D7 is sent from the MPU 45 to the display 10.

The above operation is repetitively performed while the current flowing through the light emitting element is varied by changing the resistance value of a variable resistor 58, so that the light receiving amount with respect to the transmittance can be adjusted optimally.

When the light receiving amount coincides with the optimal value, a predefined LED may be lighted or a buzzer may be rung.

It does not matter that this embodiment may be configured as follows.

The amplification factor of the light receiving current may be changed by making the resistor for the current-to-voltage conversion variable without making the adjustment on the light receiving side.

Also, the input from the operation unit 57 and the output to the display may be directly connected to the control element 44, without intervention of the MPU 45, and where the MPU 45 is not involved in displaying the difference between the actual light receiving amount and the optimal light receiving amount at all.

The present invention is not limited to the above embodiments, and various modifications may be made within the scope of the invention as defined in the claims.

What is claimed is:

1. An apparatus for detecting the amount of remaining developer comprising:

a detector for detecting a remaining amount of a developer within a developer container;

a first memory in which a reference value for a comparison with a detection signal from said detector is prestored;

a second memory for storing a reference value read from said first memory;

first input means for inputting manually an instruction for modifying the reference value stored in said second memory;

second input means for inputting manually a new reference value when an instruction is inputted by said first input means;

modifying means for modifying the reference value stored in said second memory based on the new reference value input by said second input means; and determination means for determining whether developer is present by comparing the reference value stored in said second memory with the detection signal from said detector.

2. An apparatus according to claim 1, wherein said detector has a light emitting element and a light receiving element for receiving light from the light emitting element.

3. An apparatus for detecting the amount of remaining developer comprising:

a detector for detecting a remaining amount of a developer within a developer container;

a memory for storing a reference value for a comparison with a detection signal from said detector and time data of a predetermined value;

first input means for inputting manually an instruction for modifying the reference value and time data memorized in said memory;

second input means for inputting manually a new reference value and new time data when the instruction is inputted by said first input means;

modifying means for modifying the reference value and time data stored in said memory based on the new reference value input by said second input means; and determination means for determining whether developer is present by comparing the reference value stored in said memory with the detection signal from said detector, and in accordance with a fact that a relation in magnitude between the reference value and the detection signal is not changed for time indicated by the time data.

4. An apparatus according to claim 3, wherein said detector has a light emitting element and a light receiving element for receiving light from the light emitting element.

5. An apparatus for detecting the amount of remaining developer comprising:

detecting means for detecting a remaining amount of a developer within a developer container, said detecting means having a light emitting element and a light receiving element for receiving light from the light emitting element;

determination means for determining whether developer is present based on the output from the light receiving element;

input means for inputting data for regulating the amount of light emitted by the light emitting element;

regulating means for regulating the amount of light emitted by the light emitting element based on the data input from said input means; and display means for displaying a difference between the output of the light receiving element and a reference light receiving amount.

6. An apparatus for detecting the amount of remaining developer comprising:

a detector for detecting a remaining amount of a developer within a developer container;

a memory in which a reference value for a comparison with a detection signal from said detector is prestored;

first input means for inputting manually an instruction for modifying the reference value stored in said memory;

second input means for inputting manually a new reference value when the instruction is inputted by said first input means;

modifying means for modifying the reference value stored in said memory based on the value input by said second input means; and determination means for determining whether developer is present by comparing the reference value stored in said memory with a detection signal from said detector.

* * * * *

UNITED STATES PATENT AND TRADEMARK OFFICE

CERTIFICATE OF CORRECTION

PATENT NO. : 5,568,233 Page 1 of 2

DATED : October 22, 1996

INVENTOR(S) : YASUO KOMADA

It is certified that error appears in the above-indentified patent and that said Letters Patent is hereby corrected as shown below: On the title page, item,

[57] ABSTRACT:

Line 1, "remain" should read --remaining--.
Line 2, "remain" should read --remaining--.

COLUMN 2:

Line 15, "tens" should read --additional tens--.
Line 59, "the of" should read --the amount of--.

COLUMN 4:

Line 53, "changes 22" should read --charger 22--.

COLUMN 7:

Line 43, "the detect-" should read --the remaining toner detect- --.

UNITED STATES PATENT AND TRADEMARK OFFICE

CERTIFICATE OF CORRECTION

PATENT NO. : 5,568,233 Page 2 of 2

DATED : October 22, 1996

INVENTOR(S) : YASUO KOMADA

It is certified that error appears in the above-indentified patent and that said Letters Patent is hereby corrected as shown below:

COLUMN 8:

Line 16, "voltage a predetermined" should read --a predetermined voltage--.

Line 64, "star-stop" should read --start-stop--.

Signed and Sealed this

Eleventh Day of March, 1997

Bruce Lehman

*Attest:*

BRUCE LEHMAN

*Attesting Officer*

*Commissioner of Patents and Trademarks*